US005713678A

United States Patent [19]

Smith et al.

[11] Patent Number: 5,713,678

[45] Date of Patent: Feb. 3, 1998

[54] LOW-PAPER SENSING APPARATUS

[75] Inventors: Michael John Smith, Ithaca; Kathleen Maginnity, Interlaken, both of N.Y.

[73] Assignee: Axiohm IPB Inc., Ithaca, N.Y.

[21] Appl. No.: 682,869

[22] Filed: Jul. 5, 1996

[51] Int. Cl.[6] ..... B41J 11/64

[52] U.S. Cl. ..... 400/613; 400/703; 400/249; 242/563; 226/45

[58] Field of Search ..... 400/613, 613.1, 400/613.2, 249, 614, 703; 242/563, 563.1, 563.2, 588, 588.3; 226/45

[56] References Cited

U.S. PATENT DOCUMENTS 4,620,184 10/1986 Nedstedt ..... 242/563

FOREIGN PATENT DOCUMENTS 0116573 6/1986 Japan ..... 400/613

OTHER PUBLICATIONS

IBM Tech. Disclosure Bulletin; vol. 23, No. 4, Sep. 1980, "Arrangement For Detecting a Web Of Tape Wrapped On a Hub".

*Primary Examiner*—Christopher A. Bennett
*Attorney, Agent, or Firm*—Salzman & Levy

[57] ABSTRACT

The present invention features a photosensing mechanism for a receipt-printing machine which senses a low condition of a paper supply roll housed within a bucket of the receipt-printing machine. The paper-supply roll has a "floating" characteristic; that is, no fixed rotational mounts align the roll within its feed bucket. The photosensing mechanism adjusts to different supply-roll positions within the feed bucket, the different positions of which result from different mounting orientations of the receipt-printing machine.

19 Claims, 8 Drawing Sheets

Position AA

Position BB

Position CC

LOW-PAPER SENSING APPARATUS

FIELD OF THE INVENTION

The invention pertains to a supply-roll sensing apparatus and, more particularly, to a sensing mechanism that is designed to detect and indicate a low-paper condition for receipt-printing machines that use a floating or "throw-in" roll of supply paper that is not rotationally anchored in the printer's paper-supply bucket.

BACKGROUND OF THE INVENTION

Retail receipt-printing machines are small devices that print sales receipts and validate customers'checks at sales counters. While these types of machines are generally placed on horizontal surfaces (such as desktops), they may also be located in other orientations (such as substantially vertically, when wall-mounted). Typical machines of this type are Model Nos. 7193 and 7156, manufactured by Axiohm Corporation of Ithaca, N.Y. Such a receipt-printing machine prints a receipt on paper that is fed from a relatively small, cylindrical, supply roll which is located in a hollow bucket or paper well. The bucket of this receipt-printing machine is designed to receive the cylindrical supply roll therein, without any rotational restraints (such as axles, spindles or anchors) to support the inner support core thereof. In other words, the supply roll is designed to float within the bucket. A floating supply-roll design allows the roll to shift within the bucket, depending on the orientation of the machine. Such an arrangement is often referred to as "throw-in" paper loading.

Problems exist in designing a low-paper sensing mechanism for the floating supply roll. One difficulty in designing such a sensor is that the optical sensing is dependent upon the location of the supply roll. In addition to shifts in the static roll position within the bucket (which are caused by different printer orientations), the lack of any roll-mounting support system allows the supply-paper roll to be subject to jumping and bouncing within the bucket, while it feeds paper.

Although the printer can be mounted in any number of positions, the Axiohm Model Nos. 7193 and 7156 are generally positioned in one of three orientations: on a substantially level surface, such as a desktop; at an angle of approximately 14° with the horizontal plane; and vertically, mounted on a wall. Each of these three mounting orientations obviously creates a different supply-roll position within the bucket. Two of the floating rest positions result from mounting the printing machine on a desktop. In one orientation, the base of the printer is disposed at a 14° angle with respect to the horizontal plane. In the other orientation, the printer base is substantially flat with respect to the horizontal plane. Thus, depending upon the printer orientation, the desktop-oriented machine naturally has its supply roll floating either at 14° off-center or at the center of the bucket. In a wall-mounted system, the paper roll shifts to the far side of the bucket. Therefore, placing a sensor adjacent the bucket to sense a low-paper condition for all three different mounting orientations is problematical. To accommodate additional, possible printer-mounting orientations represents an enormous problem. A sensor (e.g., a photosensing device) must be able to read the supply-roll condition, regardless of printer orientation.

It is not an easy task to design a reflective photosensing mechanism that can sense an object which changes its position with respect to the sensor mounting. When the supply roll moves beyond the eye of the sensor's reflective beam, the sensor is unable to assess the low-paper condition of the supply roll.

The present invention reflects the discovery that a specially adapted photosensor, when combined with appropriate, software-operated controls, can reliably sense a low-paper condition, irrespective of the floating supply roll's position in the bucket. Additionally, the inventive software-based techniques provide reliable, low-paper indications, despite the bouncing and jumping of the unrestrained paper-roll within the paper-bucket.

DISCUSSION OF RELATED ART

A typical, roll-end detector is illustrated in Pat. No. 3,709,604 (issued to NIESEN et al on Jan. 9, 1973). The beam-reflective detector is fixed to a stationary mount, as are most such detectors. A reflective beam is directed at a supply roll. When the supply roll empties to the point at which the roll's supportive core is bare, the angle of the reflected beam becomes coincident with the angle at which the detector's eye is focused. Such a device naturally requires a fixed mounting position, in order to create an optical alignment of beam and eye.

The present invention differs from the above patented device in that its mounting position can vary, and yet it is still able to provide the necessary optical alignment for low supply-roll sensing. In addition, for a specified printer orientation, the photosensing device of this invention is uniquely adjustable to the position of the supply roll resting within its bucket.

SUMMARY OF THE INVENTION

In accordance with the present invention, there is provided a photosensing mechanism that senses a low condition of a paper-supply roll housed within a receipt-printing machine. The paper supply roll has a "floating" characteristic; that is, no fixed rotational mechanism aligns the roll within its feed bucket. The photosensing mechanism of this invention may be adjusted to several predetermined positions, so as to accommodate different supply-roll positions within the feed bucket, with differing positions resulting from different orientations of the receipt-printing machine.

The present invention features an easily adjustable, photosensing mechanism that may be preset to accommodate different supply-roll positions within the bucket of the receipt-printing machine. In addition, a software-implemented, "de-bounce" strategy is employed, so as to ensure against false positive indications (i.e., to help ascertain that the low-paper condition exists, due to the possibility of supply-roll bouncing within the bucket).

The photosensor of this invention uses a reflective beam and eye arrangement mounted on an arcuate bracket rail that is affixed to the supply bucket. The bracket rail allows the photosensor to be arcuately shifted therealong. A friction pad mounted upon the surface of the photosensor provides sufficient friction to hold the photosensor assembly in position during normal machine operation, while also allowing for easy adjustment when necessary. This movable arrangement allows the low-paper function to perform predictably with the machine, when the latter may be in a variety of orientations; the photosensor can be appropriately adjusted to accommodate resulting variations in the paper supply-roll position in the bucket. Another advantage of the shiftable photosensor is that a customer may make a simple, positional adjustment in order to receive an earlier or later warning of a low-paper condition, if suitable for their needs.

A photo beam of the photosensor reflects off the side of the paper roll; it is sensed by the photosensor's eye. The sensor indicates when the roll is becoming low, because the photo beam fails to reflect off the roll when the size of the supply roll disappears past the eye of the beam. When the paper nears the depletion state, the beam will miss the remainder of the roll, and thus will not be reflected. Minor adjustments of the photosensor may be made to determine at what particular point in the remainder of the paper a low-paper signal will be issued. Reliable operation of the low-paper detection system of the present invention is ensured by the use of "de-bounce" sampling software. This de-bounce software only provides a low-paper warning signal after a predetermined number of samples of the reflective photosensor have been registered.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Generally speaking, the invention features a sensing mechanism for a receipt-printing machine. The sensing mechanism is able to determine when a supply roll of paper is near depletion. The paper roll is deposited in a supply bucket without any rotational restraints, so that the paper roll is floating within the bucket chamber. The receipt-printing machine can be mounted in several different orientations, each of which alters the position that the supply roll occupies within the bucket. The sensing mechanism may be easily adjusted to accommodate the various positions that the supply roll assumes inside the bucket.

Figure 1:
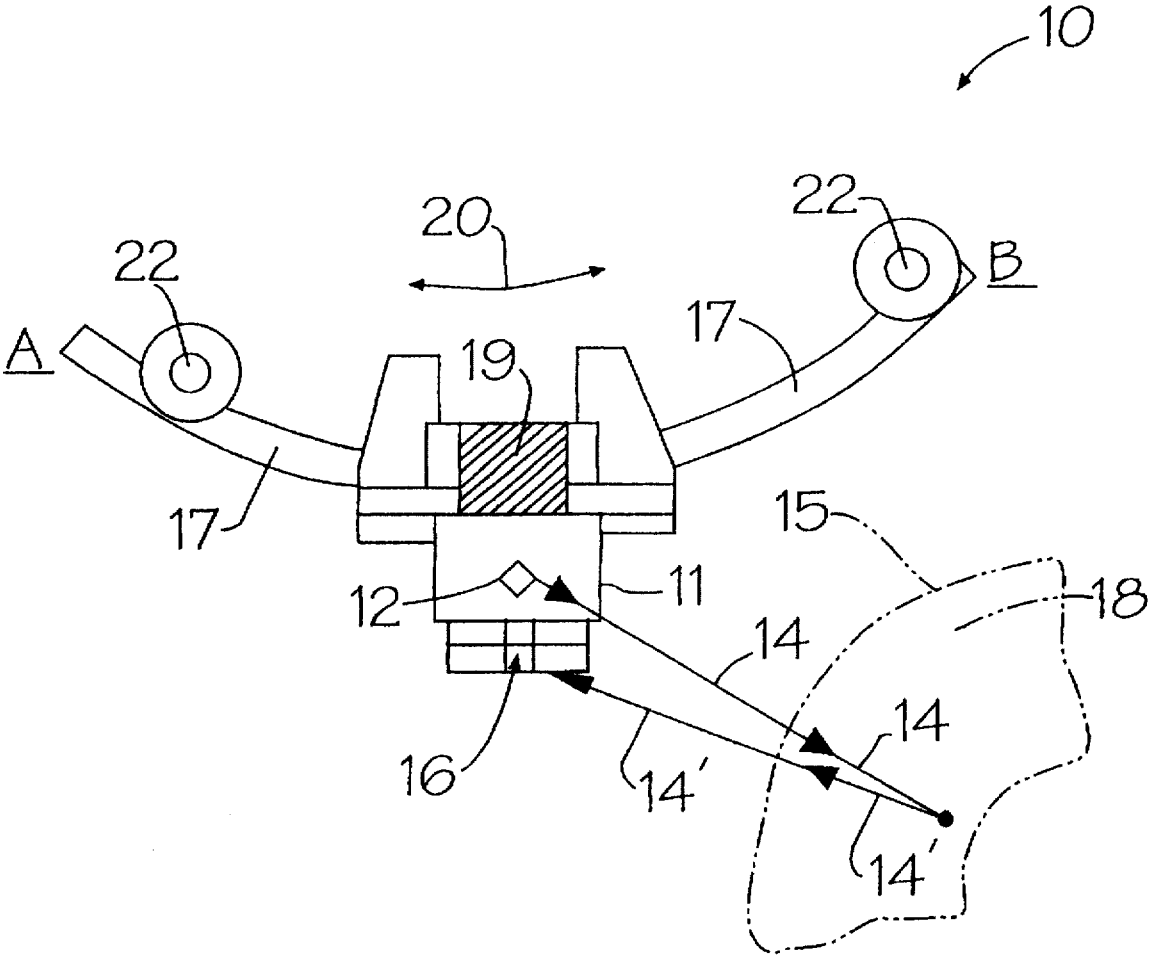
FIG. 1 illustrates a front view of the photosensing mechanism of this invention.

Now referring to FIG. 1, a front view of the photosensing mechanism 10 of this invention is shown. The photosensing mechanism 10 comprises a reflective sensing unit 11 that has a light-emitting diode (LED) 12 which directs a light beam 14 upon the side 18 of an adjacently disposed supply roll 15. The light beam 14 normally bounces off the side 18 of the supply roll 15, when the wound supply roll 15 contains at least a minimum amount of paper. The reflected light beam 14' from the supply roll 15 is received by the eye 16 of the reflective sensing unit 11.

The reflective sensing unit 11 is movably mounted upon an arcuate bracket rail 17. A friction pad 19 is mounted upon the outer surface of the reflective sensing unit 11. The friction pad 19 provides sufficient friction between the reflective sensing unit 11 and the arcuate bracket rail 17 to hold the reflective sensing unit 11 in position during normal printer operation. The friction is small enough, however, to allow for easy movement of the reflective sensor unit 11 with respect to the arcuate bracket rail 17 during factory or field adjustment, as described hereinbelow.

Figure 2:
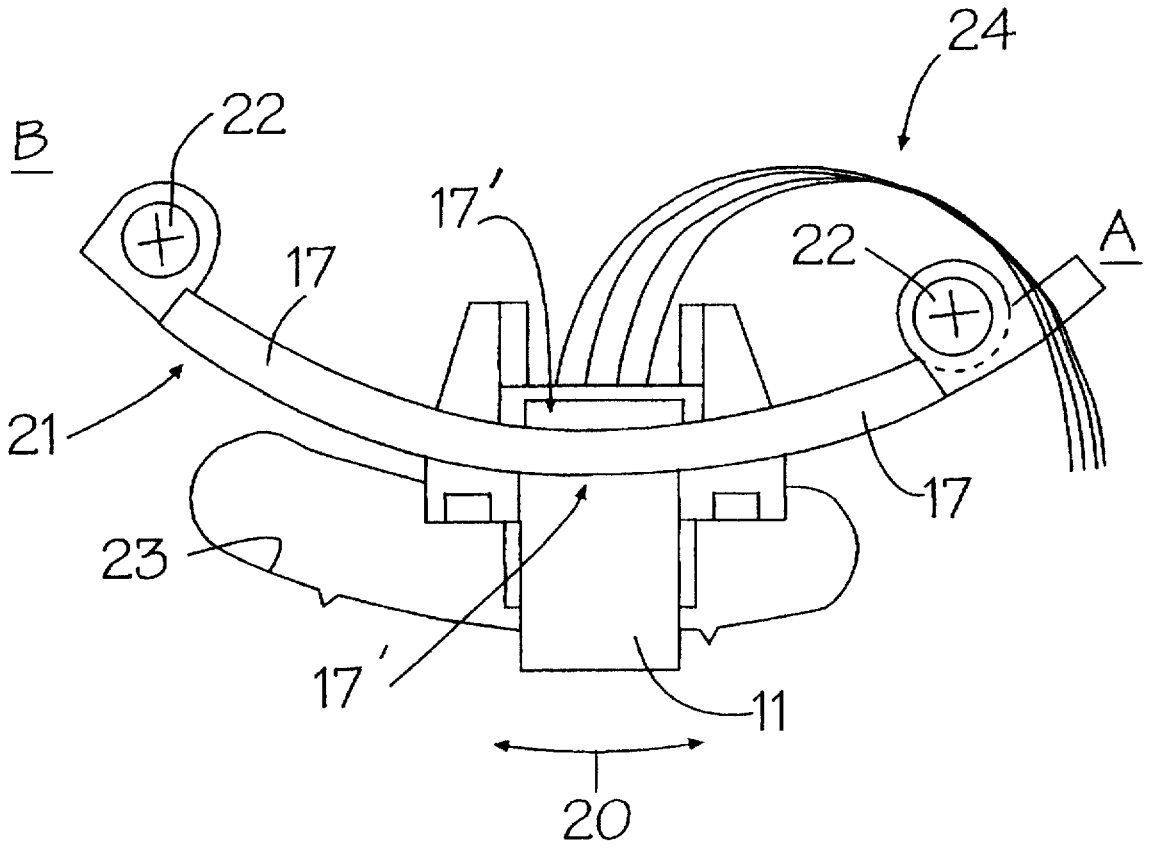
FIG. 2 depicts a back view of the photosensing mechanism shown in FIG. 1.

Referring to FIG. 2, the arcuate bracket rail 17 is disposed in a conforming, arcuate channel 17' that is disposed on the back of the reflective sensing unit 11, as shown. The arcuate channel 17' allows the reflective sensing unit 11 to slide along the arcuate bracket rail 17 in either a clockwise or counterclockwise direction, as shown by arrows 20. The arcuate bracket rail 17 is mounted to a wall 21 of the housing of the supply bucket (not shown) by a pair of screws 22, respectively disposed on distal ends "A" and "B" of the arcuate bracket rail 17. The light beam 14 generated by the LED 12 (FIG. 1) is directed through an arcuate window 23 in the bucket-housing wall 21. Electrical wires 24 running to the reflective sensing unit 11 carry signals to and from the receipt-printing machine to energize the LED 12, and convey the signal from the eye 16 (FIG. 1), until such time as the paper supply is depleted.

Figure 3:
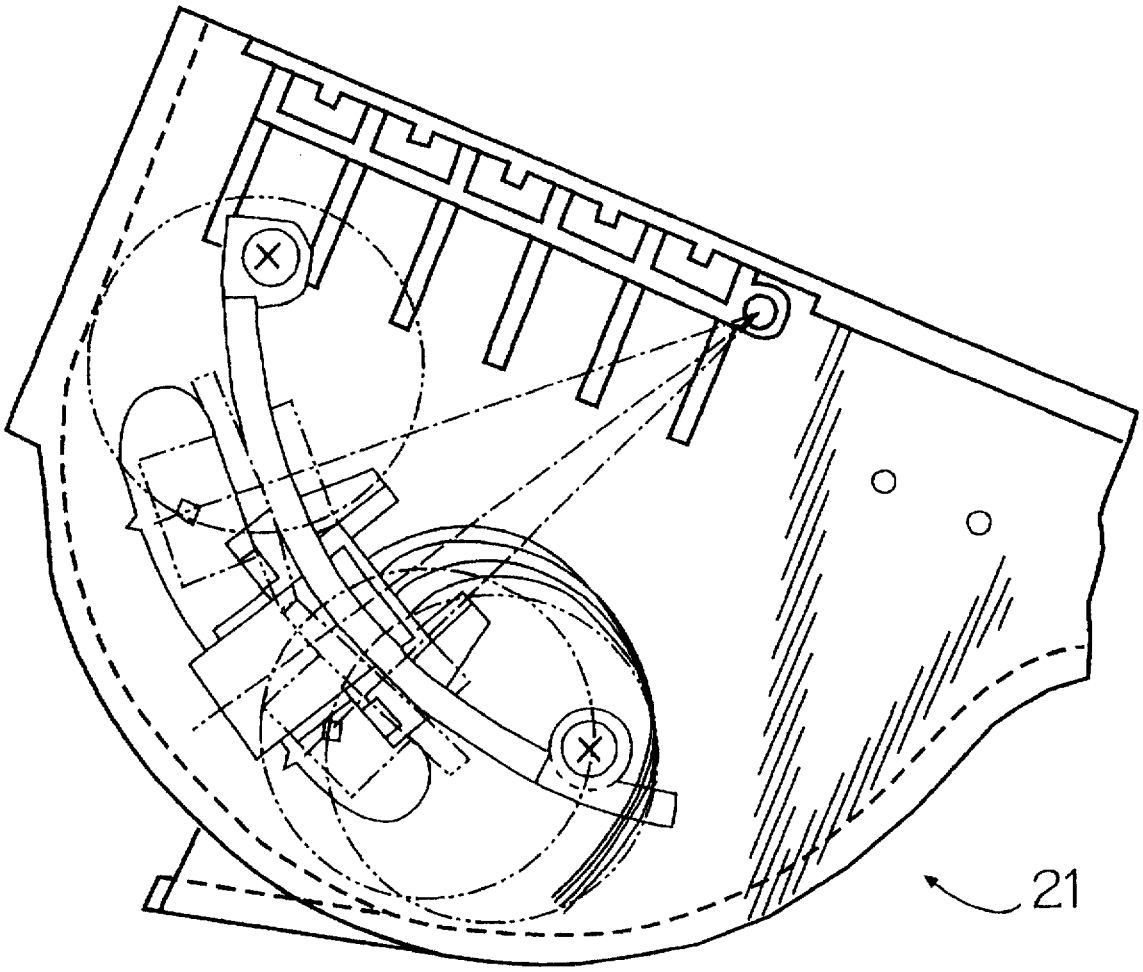
FIG. 3 illustrates a bucket orientation that results from positioning the receipt-printing machine at 14° with respect to the horizontal plane.
Figure 4:
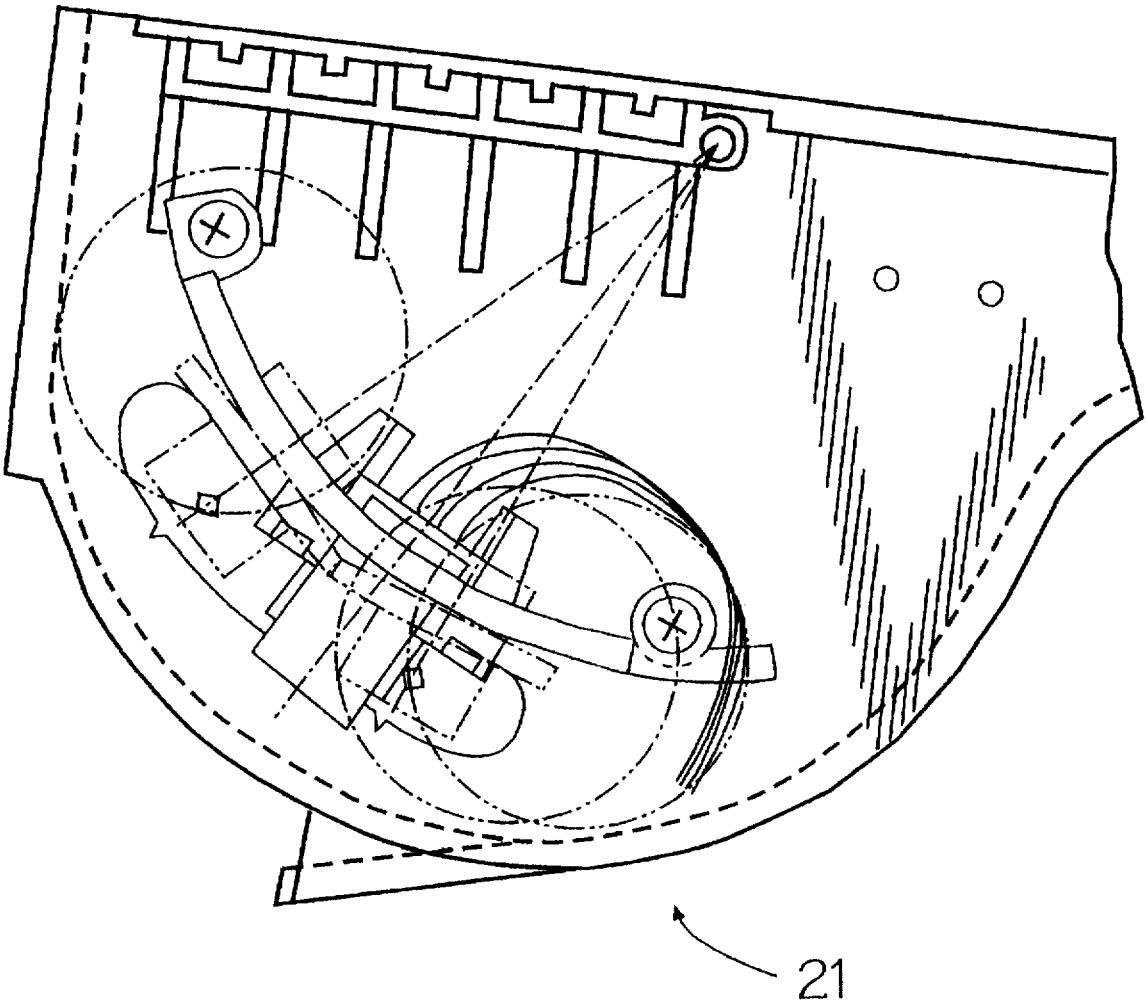
FIG. 4 illustrates a bucket orientation that results from positioning the receipt-printing machine at 0° with respect to the horizontal plane.
Figure 5:
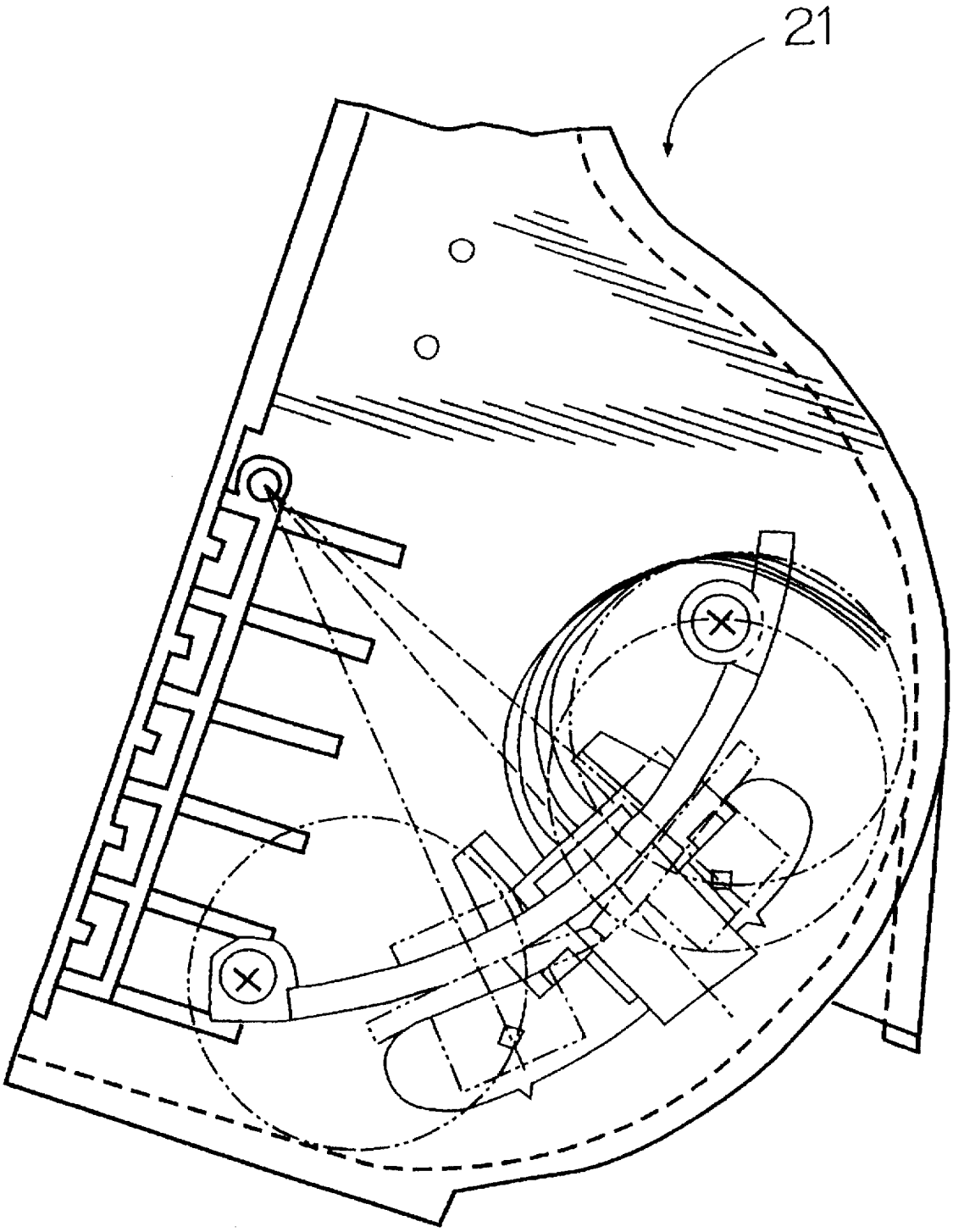
FIG. 5 illustrates a bucket orientation that results from positioning the receipt-printing machine at 90° with respect to the horizontal plane.

Referring to FIGS. 3 through 5, three different bucket positions are illustrated for three different receipt-printing machine orientations associated with this invention.

FIG. 3 depicts a feed bucket 21 that is angled at 14° with respect to the horizontal plane, which is typical of a machine orientation mounted to the top of a desk. This position is given the designation "AA".

FIG. 4 depicts a bucket 21 that is at a substantially flat (0° ) angle with respect to the horizontal plane, which may also be characteristic of a desktop-mounted, receipt-printing machine. This position is given the designation "BB".

FIG. 5 depicts a bucket 21 that is at a substantially right angle (90° ) with respect to the horizontal plane, which is typical of a receipt-printing machine that is wall-mounted. This position is given the designation "CC".

Figure 6:
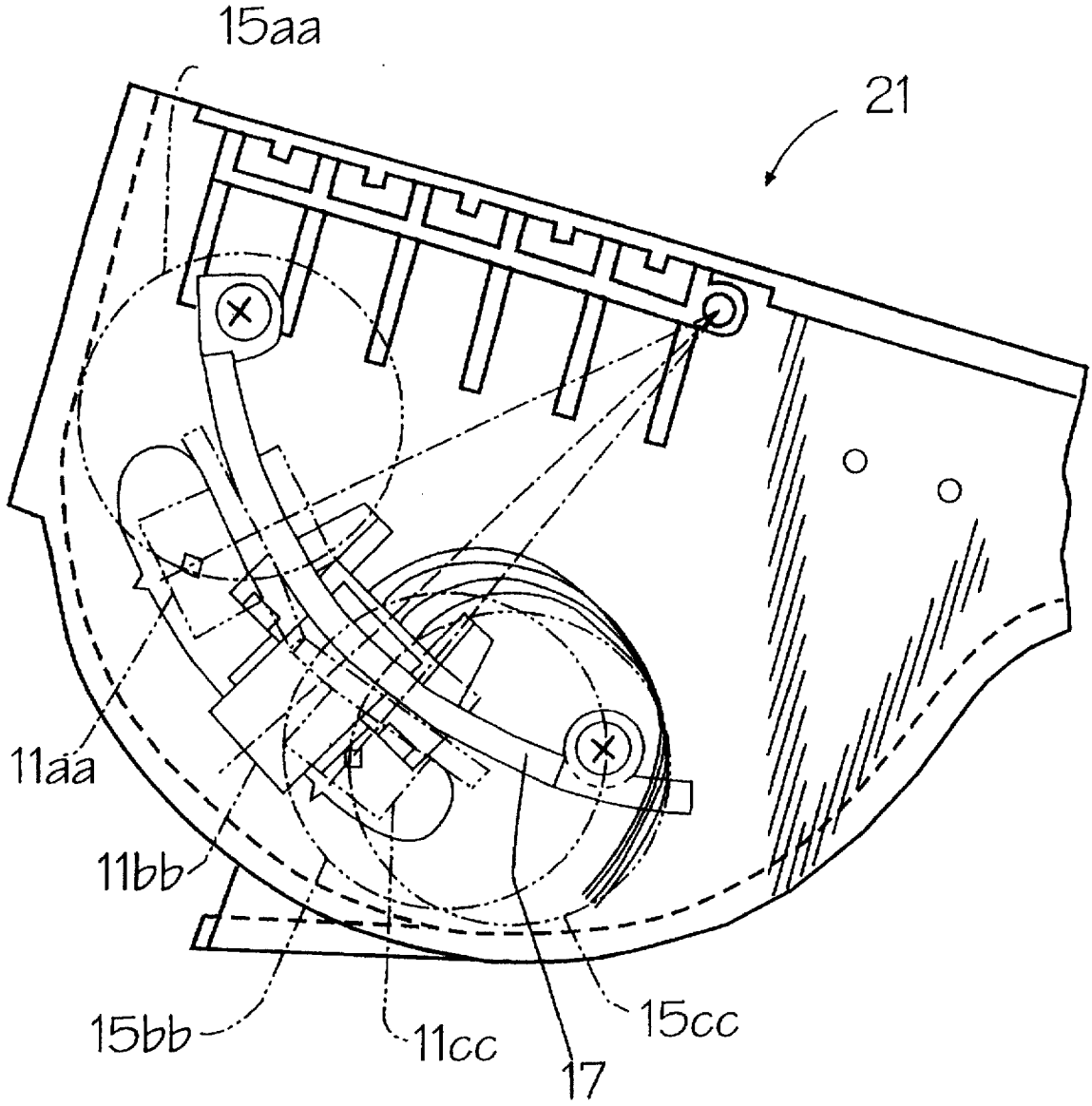
FIG. 6 shows an enlarged view of a supply bucket, a supply roll and the inventive photosensing device, with phantom views of the supply roll and photosensing device in three different positions.

Referring to FIG. 6, an enlarged view of the supply bucket 21 shown in FIGS. 3 through 5 is shown. The supply roll 15 and the reflective sensing unit 11 are illustrated in three respective, designated positions **15*aa*, 11*aa* (phantom view); 15*bb*, 11*bb* (solid view); and 15*cc*, 11*cc* (phantom view), all of which correspond to the different bucket 21** orientations AA, BB and CC (FIGS. 3 through 5).

The position supply roll **15*aa*, 15*bb* or 15*cc* within the bucket 21 moves in accord with the orientation of the printer in respective positions AA, BB or CC. Regardless of the orientation of the printer, the reflective sensing unit 11** may readily be adjusted to maintain a reliable, low-paper condition signal.

Figure 7:
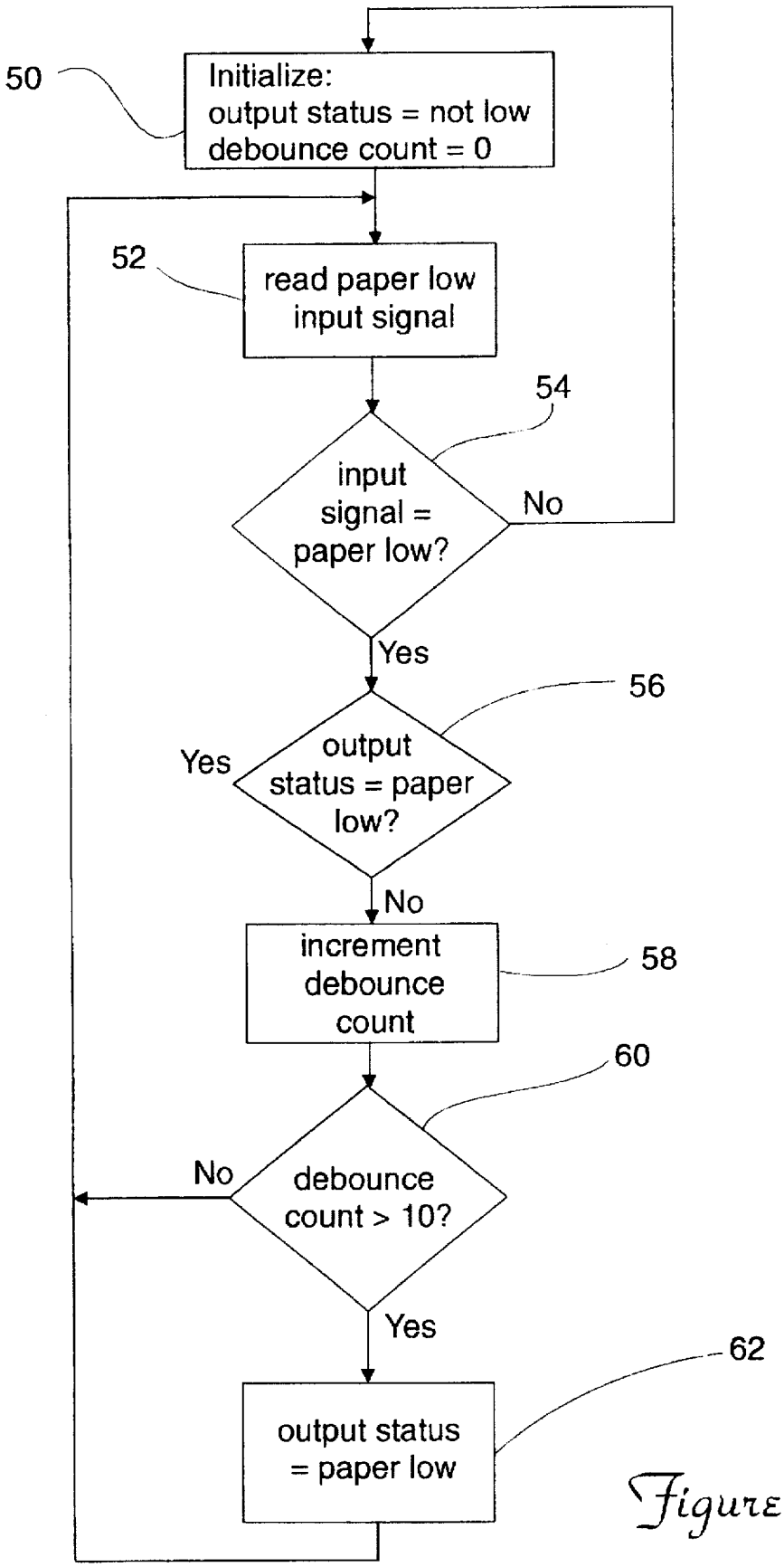
FIG. 7 is a flowchart of the "de-bounce" software of the low-paper detection system Of the present invention.

Referring now to FIG. 7, there is shown a flowchart of the steps of the software-implemented, "de-bounce" system that forms a part of the present invention. Two signals, Output Status and Debounce Count, are first initialized to "not-low" and "0", respectively, step 50. The Paper Low Input Signal is next read from the reflective photosensor 11 (FIGS. 1–6), step 52. The Paper Low Input Signal is tested for a state of "low", step 54. If the Paper Low Input Signal indicates that paper is not low (a normal condition, with sufficient paper in the printer), control is returned to initialization, step 50. If the Paper Low Input Signal indicates that paper is low, the Output Status level is checked, step 56. If the Output Status level already indicates that a low-paper condition is present, the system again checks for a "low" state, step 52. If the Output Status level does not indicate a low-paper condition, the Debounce Count signal is incremented, step 58. The Debounce Count is then compared with a predetermined number, step 60. In the preferred embodiment, a predetermined count of ten has been found to provide satisfactory results. If a Debounce Count of ten has not been reached, step 60, the system again checks for a low state, step 52. If a Debounce Count of ten has been reached, step 60, the low-paper Output Status signal is set to indicate paper low, step 62, and, once again, the system checks for a low state, step 52. This process continues until the paper roll is replaced and the paper input signal is no longer low, step 52, and the system is re-initialized, step 50.

Figure 8:
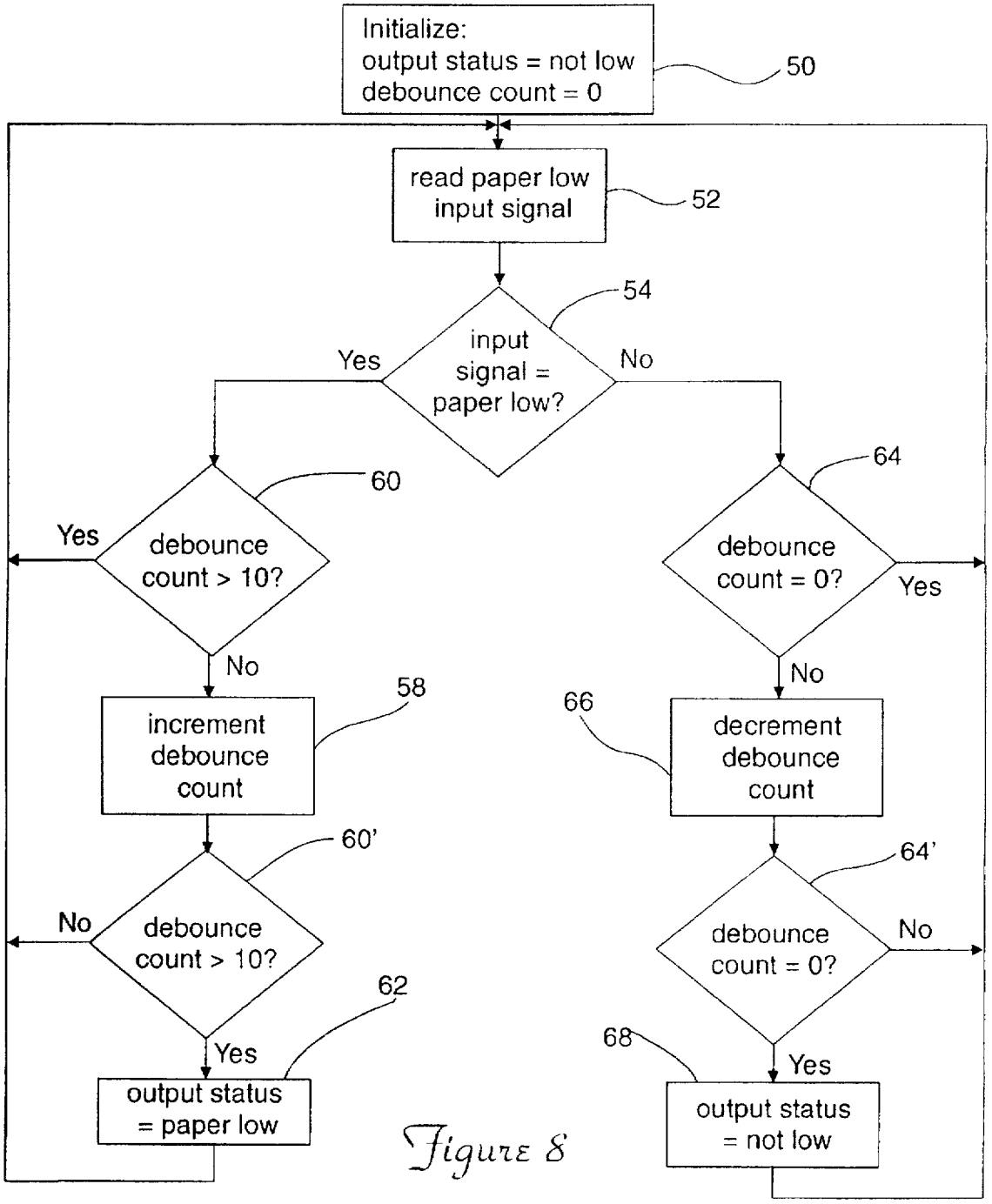
FIG. 8 is a flowchart of an alternate embodiment of the de-bounce software of the low-paper detection system of the present invention.

Under normal operating conditions, the aforementioned method has been proven to provide reliable, low-paper indications. A flowchart of an alternate embodiment of the de-bounce method is shown in FIG. 8. This is a more robust embodiment, where the Debounce Count signal is both incremented and decremented in response to the Paper Low Input Signal and the low-paper Output Status. Two signals, Output Status and Debounce Count, are first initialized to "not-low" and "0", respectively, step 50. The Paper Low Input Signal is next read from the reflective photosensor 11 (FIGS. 1–6), step 52. The Paper Low Input Signal is tested for a low state, step 54. If the Paper Low Input Signal is not low (the normal condition, with sufficient paper in the printer), control is passed to decision step 64. The branch containing decision step 64 will be discussed in further detail hereinbelow. If the Paper Low Input Signal is low, step 54, the Debounce Count signal is compared with a predetermined number, step 60. If the Debounce Count is greater than ten, step 60, the Paper Low Input Signal is again read, step 52. If the Debounce Count signal is not greater than ten, step 60, the Debounce Count is incremented, step 58, and again compared with the predetermined number ten, step 60'. If the Debounce Count is less than or equal to ten, the Paper Low Input Signal is again read, step 52. If, however, the Debounce Count is greater than ten, step 60', the Output Status level is set to indicate a low-paper condition, step 62, and the control is again passed to step 52.

Returning to decision step 54, if the Paper Low Input Signal is high (not low), step 54, the Debounce Count is checked, step 64. If the debounce is equal to zero, the Paper Low Input Signal is again read, step 52. If the Debounce Count is not equal to zero, step 64, the Debounce Count is decremented, step 66, and is again compared to zero, step 64'. If the Debounce Count is not equal to zero, step 64', the Paper Low Input Signal is again checked, step 52. If the Debounce Count is equal to zero, step 64', the Output Status signal is set to indicate that paper is no longer low, step 68, and the Paper Low Input Signal is again read, step 52.

It will be obvious to those skilled in the art that although an optical, reflective, photosensor has been chosen for purposes of disclosure, the present invention could be implemented by using a photo-transmissive (i.e., see-through) sensing system, an ultrasonic sensing system (either reflective or see-through), a pneumatic sensing system, or any other suitable technology for accomplishing this paper-sensing function.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A photosensing mechanism that senses a low paper condition in combination with a receipt printing machine having a feed bucket configured to receive a floating paper supply roll therein, said photosensing mechanism having means for adjusting to any one of a predetermined number of different supply-roll positions within said feed bucket, said different positions resulting from different mounting orientations of the receipt-printing machine.

2. The photosensing mechanism for determining a low-paper condition in accordance with claim 1, wherein said photosensing mechanism generates an output signal that is indicative of a low-paper condition, said output signal being operatively connected to said receipt-printing machine.

3. The photosensing mechanism for determining a low-paper condition in accordance with claim 2, further comprising:

means for sampling said output signal at least twice before said output signal is transmitted to said receipt-printing machine.

4. The photosensing mechanism for determining a low-paper condition in accordance with claim 3, wherein said output signal comprises an electrical output signal and wherein said means for sampling said output signal comprises an electrical circuit.

5. The photosensing mechanism for determining a low-paper condition in accordance with claim 3, wherein said output signal comprises an electrical output signal and wherein said means for sampling said output signal comprises a printer control program.

6. A sensing mechanism for determining a low-paper condition of a roll of supply paper used for printing receipts in a receipt-printing machine, comprising:

a bucket for housing a roll of supply paper for printing receipts thereupon, said roll of supply paper being movably housed within said bucket, so as to provide a "floating" position with respect to said bucket;

a sensing device being movably mounted adjacent said bucket and having means for generating an electromagnetic beam, and a receptor for detecting changes in said electromagnetic beam, said changes being indicative of paper remaining on said roll; and a rail supported by said bucket for mounting said sensing device for movement about said bucket, said sensing device being movable along said rail, so that it can be positioned proximate the roll of supply paper in at least one of a plurality of different positions within said bucket, whereby said sensing mechanism is adjustable about said bucket to assume different orientations with respect to said supply roll.

7. The sensing mechanism for determining a low-paper condition in accordance with claim 6, wherein said sensing mechanism comprises an optical, reflective sensor.

8. The sensing mechanism for determining a low-paper condition in accordance with claim 6, wherein said sensing mechanism comprises an optical, transparent sensor.

9. The sensing mechanism for determining a low-paper condition in accordance with claim 6, wherein said sensing mechanism comprises ultrasonic sensing means.

10. The sensing mechanism for determining a low-paper condition in accordance with claim 6, wherein said sensing mechanism comprises pneumatic sensing means.

11. The sensing mechanism for determining a low-paper condition in accordance with claim 6, wherein said receptor generates an output signal that is indicative of a low-paper condition, said output signal being operatively connected to said receipt-printing machine.

12. The sensing mechanism for determining a low-paper condition in accordance with claim 11, further comprising:

means for sampling said output signal at least twice before said output signal is transmitted to said receipt-printing machine.

13. The sensing mechanism for determining a low-paper condition in accordance with claim 12, wherein said output signal comprises an electrical output signal and wherein said means for sampling said output signal comprises an electrical circuit.

14. The sensing mechanism for determining a low-paper condition in accordance with claim 12, wherein said output signal comprises an electrical output signal and wherein said means for sampling said output signal comprises a printer control program.

15. A method for detecting a low-paper condition in a printer having a paper-supply bucket and a floating roll of supply paper, the steps comprising:

a) sensing the absence of a signal representing the presence of paper at a predetermined position in a paper-supply bucket;

b) comparing said sensing step (a) with a previously-sensed absence signal;

c) repeating said sensing step (a) and said comparing step (b) a predetermined number of times, in order to eliminate bouncing effects of a floating roll of supply paper, which may falsely register said paper supply as being high; and d) after steps (a) and (b) have been performed said predetermined number of times, during which said absence of signal sensing has been established, indicating to an operator that said roll of supply paper has been substantially exhausted.

16. The method for detecting a low-paper condition in accordance with claim 15, wherein said sensing step (a) is performed with a photosensing device.

17. The method for detecting a low-paper condition in accordance with claim 16, wherein said photosensing device comprises a reflective device.

18. The method for detecting a low-paper condition in accordance with claim 16, wherein said photosensing device is movably mounted proximate said roll of supply paper.

19. A sensing mechanism for determining a low-paper condition of a roll of supply paper used for printing receipts in a receipt-printing machine, comprising:

a bucket for housing a roll of supply paper for printing receipts thereupon, said roll of supply paper being movably housed within said bucket, so as to provide "floating" positions with respect to said bucket;

a sensing device being movably mounted adjacent said bucket and having means for generating an electromagnetic beam, and a receptor for detecting changes in said electromagnetic beam, said changes being indicative of paper remaining on said roll; and support means for said sensing device associated with said bucket, and defining an arcuate path of movement for said sensing device that allows said sensing device to move with respect to said bucket, said sensing device being movable along said arcuate path so that it can be positioned proximate the roll of supply paper in at least one of a plurality of different positions within said bucket, whereby said sensing mechanism is adjusted to accommodate different orientations of said supply roll.

* * * * *